United States Patent [19]

Rausch et al.

[11] 4,062,484

[45] Dec. 13, 1977

[54] ABRASION RESISTANT FILAMENT WEAR GUIDES AND METHOD OF MAKING SAME

[75] Inventors: John J. Rausch, Antioch; Ray J. Van Thyne, Oak Lawn, both of Ill.

[73] Assignee: Surface Technology Corporation, Oak Lawn, Ill.

[21] Appl. No.: 604,172

[22] Filed: Aug. 13, 1975

Related U.S. Application Data

[63] Continuation-in-part of Ser. No. 388,809, Aug. 16, 1973, abandoned.

[51] Int. Cl.[2] ..... B65H 23/04

[52] U.S. Cl. ..... 226/196; 242/76; 242/157 R; 427/377

[58] Field of Search ..... 226/196–199; 242/76, 157 R; 427/377

[56] References Cited

U.S. PATENT DOCUMENTS

| | | | |
|---|---|---|---|
| 3,642,517 | 2/1972 | Faber | 427/377 |
| 3,787,229 | 1/1974 | Rudness | 242/157 R X |

*Primary Examiner*—Richard A. Schacher

*Attorney, Agent, or Firm*—Vogel, Dithmar, Stotland, Stratman & Levy

[57] ABSTRACT

Filament wear guides which are characterized by excellent resistance to abrasive filament wear. Also, the method of their fabrication. A chromium surface on a substrate is controllably nitrided. Such nitriding is accomplished thermally. Resulting chromium nitride surface layer is non-particulate and substantially impervious.

3 Claims, 1 Drawing Figure

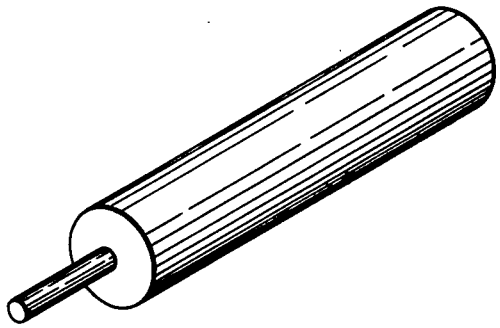

ABRASION RESISTANT FILAMENT WEAR GUIDES AND METHOD OF MAKING SAME

CROSS REFERENCE TO RELATED APPLICATION

This application is a continuation in part of our copending application of the same title Ser. No. 388,809 filed Aug. 16, 1973 now abandoned.

BACKGROUND OF THE INVENTION

This invention relates to chromium nitride coated filament wear guides and to the method of their manufacture.

As is well-known to workers in the field, in the handling of threads, yarns and the like, the guide structures over which the threads, etc. pass must be characterized by both excellent wear resistance and controlled friction as between the running thread and the guide surface. The problem has been somewhat magnified in recent years by the development and growing use of synthetic threads which are even more abrasive than naturally occurring fibers. For efficient production without undue down time to replace the guide members (along with the replacement cost thereof) it is highly desirable that such guides serve for very extended periods without causing filament damage. To provide a method of readily and easily producing such desirable new guides is one of the principal purposes of this invention. As is set out below in some detail the nitrided structures produced as herein taught are very well suited for textile wear guide purposes.

We recognize that, generally speaking, the use of a chromic oxide surface on a thread guide device is old in that art. See U.S. Pat. No. 3,080,135 of R. P. Steijn. Such patent discloses the making of textile wear guides having a chromic oxide operating surface by the following methods:

a. from solid chromic oxide pieces — ceramics — followed by grinding to the desired smoothness; and b. flame spraying of chromic oxide onto a substrate, then followed by grinding, etc., to the desired smoothness.

In practice we find that such prior art devices suffer various shortcomings which are readily overcome by the use of the present invention. The solid ceramics not only are relatively brittle, with the attendant handling and installation problems in commercial use, but also are generally made with a high friction surface which necessitates complex secondary finishing operations to provide the controlled frictional surface. Similarly, the ceramic coated metals, produced by flame spraying do not inherently have useable low friction surfaces as fabricated. Both of these materials are rather rough, have undesirable snagging characteristics, and cause yarn damage unless extensively finished in a secondary operation.

It also should be noted that many textile wear guides are very small structures. As is alluded to in the Steijn patent, the chromic oxide flame spraying technique is mostly limited in application to parts having relatively simple geometry because of the line-of-sight nature of the process.

In our copending patent application entitled "Wear Resistant Filament Wear Guides and Method of Making the Same" Ser. No. 388,812 filed Aug. 16, 1973, now abandoned and replaced by continuation-in-part application Ser. No. 606,755 filed Aug. 22, 1975, we disclose a novel method of making improved chromium oxide surfaced filament wear devices. We have now discovered, very surprisingly, that a chromium nitride surface formed upon a non-particulate continuous, integral chromium surface has outstanding resistance to abrasive filament wear. Such surface is solely chromium nitride.

The nitriding of chromium to improve its hardness and wear resistance has been previously disclosed—see German Offenlegungsschrift No. 1,902,209, Jan. 17, 1969 of A. U. Seybolt. Although it is known that chromium can be hardened with nitrogen no one has recognized the remarkable resistance to abrasive filament wear that this material possesses. Although chromium nitride is hard it is considerably softer than materials such as chromium boride or titanium carbide. Nevertheless, the abrasive filament wear resistance of chromium nitride is far superior to that of either chromium boride or titanium carbide as will be shown later in this specification. We find that chromium nitride as formed by our process is comparable to or only slightly inferior to the chromium oxide of our copending patent application described above. Both of these materials are the most resistant to abrasive filament wear of all the materials that we have investigated. There are numerous other advantages to chromium nitride as will be subsequently described.

We also note U.S. Pat. No. 3,743,551 directed to razor blades having exceptionally thin coatings of chromium oxide and nitride thereon. Such coatings, which have a maximum thickness of a few hundred angstrom units do not have the outstanding abrasive filament wear resistance as produced in the devices of our invention.

Another prior art patent is that of Rudness, U.S. Pat. No. 3,787,229 "Low Friction, Wear-Resistant Material". Here spheres or spheroids of various ceramic materials are partially embedded in a matrix or binder layer. Mentioned as binders are various resins, rubber, ceramic, glass and metal which are capable of adhering to the substrate and of retaining the embedded rounded particles thereon. Such patent shows that the resulting surface consists of at least two substances—the hard, discrete particles embedded in a softer matrix binder.

In the present invention, on the other hand, a chromium layer deposited on the filament wear guide shaped substrate is nitrided by reaction with a nitriding reactant to form a surface which is in conformity with the layer. If such layer is smooth and uninterrupted the chromium nitride replicates on this. If the chromium layer has a so-called "matte" finish, i.e., somewhat wavy, so also will the chromium nitride layer reacted thereon. And if the chromium has a crack mosaic, as is oftentimes the case, the chromium nitride conforms to this with the added proviso that the nitride layer or zone is quite continuous.

Thus, in distinction to all of prior art teachings, we have developed a method of forming chromium nitride coated thread guides, or the like, which are not brittle, have excellent handling characteristics, are formed directly upon nitriding without the necessity of a secondary surfacing operation, and are useful in making thread guides of practically any size.

In the present invention, a chromium deposit on a substrate member in the form of a textile wear guide is nitrided.

Accordingly, a principal object of our invention is to provide devices characterized by excellent filament wear abrasion resistance and low friction to filaments passing thereover by the practice of the present process.

Another object of our invention is to provide a novel method of producing filament wear guides having a nitrided chromium surface zone thereon.

These and other objects, features and advantages of our invention will become apparent to those skilled in this art from the following detailed disclosure thereof and the accompanying drawing, FIG. 1, which illustrates one representative embodiment of the present devices.

In the present specification reference is made to "thermally formed" nitride layers on a chromium surface. By this is meant that such layers are formed by reaction with nitrogen at elevated temperatures.

DESCRIPTION OF THE PREFERRED EMBODIMENTS

We have found that a thermally formed nitride which is developed as a surface layer on chromium plate has outstanding resistance to abrasive filament wear.

In the practice of this invention, for reasons subsequently considered in this specification, the chromium layer or surface must be essentially pure and have a thickness of at least 5 microinches.

For most applications the preferred range of chromium thickness is from 0.1 to 4 mils.

We would also note that the rate of nitriding of chromium is quite rapid when compared to the rate of carburizing, boronizing or oxidizing. At temperatures above 1800° F, there is an abrupt increase in the rate of nitriding.

We find that certain unique metallographic structures are formed when electrodeposited chromium is nitrided. Such chromium normally contains cracks or similar flaws many of which run normal to the chromium plate-substrate interface. These flaws are commonly developed in normal commercial plating and chrome plated commercial thread guides have such plating flaws. Techniques exist to minimize the occurrence of such flaws. However, in any case, upon heating the material stress relief causes the chromium to crack thereby forming a mosaic crack network boundary when viewed normal to the surface thereof. When such material is heated in the presence of nitrogen, these elements diffuse rapidly along the fault boundaries and penetrate to the chromium plate-substrate interface long before the bulk chromium, i.e., within the mosaic network, is reacted. Nitrogen diffuses very rapidly from the crack boundaries into the bulk chromium and also diffuses rapidly in a lateral manner along the substrate-chromium interface reaction zone. Thus, in addition to planar diffusion from the surface inward, we find that in such materials unique composite structures are formed in which the nitrogen which diffuses along such fault boundaries, reacts to form compounds which serve to reinforce the entire coating system. In our invention an uninterrupted, continuous chromium nitride phase is presented to the passing thread.

When chromium is nitrided at low pressures and relatively high temperatures, above approximately 2000° F, the outer layer that forms is rather porous. Such surface layers are quite hard and have useful abrasion resistance. The porous layers thus formed also serve as an excellent structure for impregnents or for the bonding of additional outer layers. The surfaces formed at these very high temperatures have different frictional and snagging characteristics unlike the surface layers formed at lower temperatures which tend to replicate the original surface finish of a chromium plate. When nitriding is done at temperatures below 1800° F the surface layer is much smoother, which is desired for many textile applications.

The structures that we form by nitriding have relatively high hardness. Micro-hardness measurements (DPN-50g load) on nitrided chromium specimens vary from 1790 to 2490.

We have found that sub-microscopic layers of chromium nitride provide useful abrasive wear resistance. However, in a preferred embodiment of our invention, a nitride layer thickness greater than 5 microinches will result in longer erosive life under certain practical operating conditions.

Moreover, for a low friction surface composed of smoothly rounded, continuously surfaced nodules, such as that commonly obtained in what is called a matte chromium finish for example, the contact pressure is higher than for a very smooth surface. Thus to obtain greater abrasive wear resistance and retain the smooth nodular surface finish during service life we prefer that the minimum chromium nitride thickness be 10 microinches or greater depending upon the size of the nodules.

One important aspect of our invention is the fact that the nitrided chromium layers do not readily spall or cause chromium to spall at the chromium-substrate interface.

Filament wear test bars, (as illustrated in FIG. 1) 0.375 in. dia. × 2 in. long were prepared of the following substrate materials Armco iron — Fe—99.75%
C1080 steel — Fe—0.80 C
446 stainless steel — Fe—25% Cr These were electroplated to produce chromium coating thicknesses of 0.2 and 2.0 mils and the materials were then heat treated at 2000° F for 4 hours in a cold wall furnace with a molybdenum heater and molybdenum radiation shields using ultra high purity nitrogen (99.999%, max. $H_2O$—3ppm, max. $O_2$ — 1 ppm) at slightly greater than atmospheric pressure. All of the chromium was converted to chromium nitride in all cases and none of the specimens spalled as a result of the heat treatment.

The thermally formed coatings of our invention must result from the reaction of essentially pure chromium with nitrogen. Thus, to avoid interdiffusion reactions with the substrate that would dilute the chromium during reaction, a minimum chromium thickness of 5 microinches is required.

In order to determine the abrasive filament wear resistance of the various materials of our invention the various nitrided wear test pins, 0.375 in. dia. × 2 in. long, were subjected to testing. The tests were run using a string (Shuford No. 24), which was tied to make a continuous length of 30 inches. The string loop is supported by the wear pin at the top and is driven by a 4 in. dia. pulley at a speed of 1800 in/min. The bottom of the pulley is continuously immersed in slurry made of 8 parts water and 1 part Titanox RA10 (pigment grade $TiO_2$ powder) from National Lead Corp., which is kept continuously agitated. The force on the pin is 200 grams.

After various periods of testing the wear pin is removed and the depth of the wear groove is measured. Specimens showing no measureable wear were examined microscopically for evidence of polishing or localized chipping of the coating.

The significance of the results can be better appreciated by reference to the following data that were obtained on standard materials:

| MATERIAL | WEAR RATE (mils/hr) |
|---|---|
| Hard Chromium Plate | 3.0 |
| Annealed C1080 | 0.45 |
| Borided chromium plate | 0.28 |
| Heat Treated 01 Steel (Rc57) | 0.2 |
| Chemical vapor deposited TiC | 0.035 |

Hard chromium plate wears at an exceptionally high rate in this test. However, even the exceptionally hard chemically vapor deposited TiC (3500DPN) and borided chromium plate (3000DPN) show significant linear wear rates. For comparison the results of filament wear tests on various nitrided chromium plated materials are summarized in Table 1. All of these specimens were heat treated as previously described.

Table 1

Filament Wear Test Data

| Substrate | Chromium Thickness (mils) | Heat Treatment ° F | Hrs. | Time (hrs) | Depth of Wear Scar (mils) | Wear Rate (mils/hr) |
|---|---|---|---|---|---|---|
| 446 Stainless Steel | 0.2 | 2000 | 1 | 1 | 0.5* | |
| C1080 | 0.2 | 2000 | 1 | 2 | 0.3* | |
| 446 Stainless Steel | 2.0 | 2000 | 4 | 8 | 0.25 | 0.031 |
| C1080 | 2.0 | 2000 | 4 | 12 | 0.05 | 0.004 |
| C1080 | 2.0 | 1650 | 4 | 4 | 0 | 0 |
| C1080 | 0.2 | 1650 | 4 | 4 | 0 | 0 |
| C1080 | 2.0 | 1500 | 4 | 4 | 0 | 0 |
| C1080 | 0.2 | 1500 | 4 | 4 | 0 | 0 |

*Broke through coating into substrate

Where thin chromium coatings (0.2 mil) are nitrided in ultra high purity nitrogen at 2000° F — 1 hr very poor abrasive filament wear resistance results. This appears to be due to interaction of the substrate with the chromium. We have found that the thinner chromium plate has less pronounced fault boundary structure. The thicker chromium coatings nitrided under similar conditions have better wear resistance and are better than borided chromium plate or CVD TiC. The specimens nitrided at lower temperatures are more wear resistant. These materials are also smoother which is a desirable attribute for many filament applications.

Nitriding obviously can be done by a number of methods. The use of pure molecular nitrogen as in our experiments is a convenient method.

From the foregoing we would note certain aspects of our invention which should be taken into consideration in the practice of our process.

The chromium should be deposited onto a metallic substrate and one should avoid total interdiffusion of the chromium and the substrate. Such chromium may be deposited completely over the surface of the piece or at least in the area thereof which is to contact the filament. In some instances we find it desirable to have residual chromium between the substrate and outer coating layer. Various metallic substrates may be employed, especially ferrous and ferrous base materials which are preferred. In the preferred embodiments hereof it is quite desirable to employ a substrate which is closely thermally expansion matched to the chromium in order to minimize spalling off of the chromium layer; or nitride upon thermal treatment.

The thickness of the chromium layer is also important. It must be of adequate thickness in order that, when nitrided or oxidized, it resists filament wear and at the same time it must be thin enough to not readily spall off when oxidized and/or nitrided. We find that chromium thickness should range between at least 5 microinches and 10 mils or more. Process economics would prefer less than 10 mils. In the preferred embodiment hereof the chromium thickness should range from 0.1 to 4 mils.

In our disclosure above we have referred to chromium electrodeposition. Other means of depositing a smooth or nodular chromium layer may also be employed herein.

It will be understood that various modifications and variations hereof may be effected without departing from the spirit or scope of the novel concepts of our invention.

We claim as our invention:

1. A filament wear guide consisting essentially of:
   a. a substrate member in the form of the wear guide;
   b. a continuous, integral chromium interlayer on said substrate member at least in the area thereof to be contacted by a filament passing thereover;
   c. a surface supported on said chromium interlayer consisting of non-particulate, continuous thermally formed chromium nitride, said surface confirming to the shape of the surface of said chromium interlayer; and
   d. wherein the combined thickness of said chromium interlayer and said chromium nitride surface is at least 5 microinches.

2. The filament wear guide as defined in claim 1 wherein said surface consists of a chromium nitride zone from 0.1 to 4 mils thick.

3. A filament wear guide consisting essentially of a substrate member in the form of the wear guide, a composite structure on said substrate member at least in the area thereof to be contacted by a filament passing thereover formed by reaction of nitrogen along the fault boundaries in chromium electroplated on said substrate.

* * * * *